US006314683B1

(12) United States Patent
Vesa et al.

(10) Patent No.: US 6,314,683 B1
(45) Date of Patent: Nov. 13, 2001

(54) SEAL

(75) Inventors: Jouko Vesa, Oulu; Timo Marjeta, Kiviniemi, both of (FI)

(73) Assignee: Nokia Networks Oy, Espoo (FI)

( * ) Notice: Subject to any disclaimer, the term of this patent is extended or adjusted under 35 U.S.C. 154(b) by 0 days.

(21) Appl. No.: 09/508,201

(22) PCT Filed: Oct. 22, 1998

(86) PCT No.: PCT/FI98/00824

§ 371 Date: Mar. 8, 2000

§ 102(e) Date: Mar. 8, 2000

(87) PCT Pub. No.: WO99/22108

PCT Pub. Date: May 6, 1999

(30) Foreign Application Priority Data

Oct. 24, 1997 (FI) ..... 974051

(51) Int. Cl.[7] ..... E06B 7/16

(52) U.S. Cl. ..... 49/496.1; 49/475.1; 49/495.1; 49/303

(58) Field of Search ..... 49/303, 304, 310, 49/314, 276, 484.1, 475.1, 495.1, 496.1, 466, 277

(56) References Cited

U.S. PATENT DOCUMENTS 1,779,215 * 10/1930 Larson .
3,263,366 * 8/1966 Woloohojian et al. .
3,739,527 * 6/1973 Schubach ..... 49/466

FOREIGN PATENT DOCUMENTS

2421010 * 11/1975 (DE) .
2421010 A1 11/1975 (DE) .
3225030 A1 1/1984 (DE) .
3225030 * 5/1984 (DE) .
3919773 * 12/1990 (DE) .
3919773 A1 12/1990 (DE) .
0157418 A2 10/1985 (EP) .
0881350 A1 12/1998 (EP) .
2170850 A 8/1996 (GB) .

* cited by examiner

*Primary Examiner*—Jerry Redman
*Assistant Examiner*—Curtis A. Cohen
(74) *Attorney, Agent, or Firm*—Pillsbury Winthrop LLP

(57) ABSTRACT

A seal attached to a door frame for mating engagement with a door. The seal including a first side for sealing engagement with a door edge, and a second side for sealing engagement with the door outer surface. The seal moves relative to the door from the door open position, where the seal first side is disposed at a first spaced apart distance from the door frame edge surface; to the door closed position, where the door moves the seal first side closer to the door frame edge surface. The seal further moves relative to the door from the door open position, where the seal second side is not disposed adjacent to the door outer surface; to the door closed position where the seal second side is disposed adjacent to the door outer surface and in covering relation to the door outer surface.

10 Claims, 3 Drawing Sheets

SEAL

FIELD OF THE INVENTION

The invention relates to a seal intended for a base station of a radio system in particular for sealing a seam between a frame and a door or the like, the seal being at least partly made of elastic material and comprising a fastening portion by which the seal is arranged to be fastened to the frame.

BACKGROUND OF THE INVENTION

It is important to protect the radio system base station against environmental effects. As it is impossible to make a totally protective cover, for example, due to service and various connections, the electronic equipment are placed inside the protective construction comprising a door or a hatch. Such doors, covers or hatches that can be opened or closed need some kind of a seal to protect the electronic equipment against such environmental effects as dust, rain or splash water. Lip seals and hollow seals made of elastic material are typical prior art seal solutions used to tightly close the seam between the door and the frame. The function of these seals is generally based on the fact that they are compressed between the door and the frame when the door is closed. However, such a use of the seal does not provide adequate tightness for base station use in particular, since the compressive force, for example, is often insignificant. The decrease in base station size also leads to a low compression of the seal due to limited space.

BRIEF DESCRIPTION OF THE INVENTION

An object of the invention is to provide a seal so as to solve the above problems, the seal thus tightening the seam between the frame and the door using insignificant compression and low compressive force. This is achieved with the type of seal described in the preamble, characterized by comprising a first sealing portion structurally fastened to a fastening portion and arranged to turn towards the seam, when closing the door, in such a manner that as the seal fills the seam between the door and the frame at least a part of the first sealing portion is arranged to extend also over an edge of the door onto an outer surface, whereby the seal provides a continuous seal structure from the outer surface of the door to the fastening portion.

Several advantages are achieved with the seal of the invention. The seal, in which the sealing portion turns towards the seam and covers the area between the seal and the door so that the seal extends slightly over the door, offers more efficient protection against dust and water than prior art solutions.

A BRIEF DESCRIPTION OF THE DRAWINGS

Figure 1A:
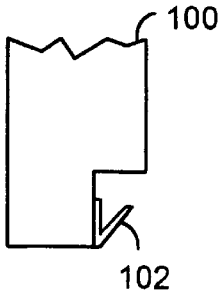
FIG. 1a (PRIOR ART)
Figure 2A:
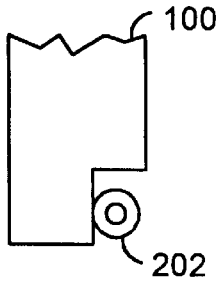
FIG. 2a (PRIOR ART)
Figure 1B:
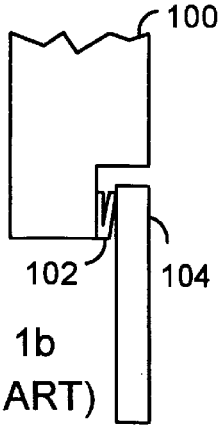
FIG. 1b (PRIOR ART)
Figure 2B:
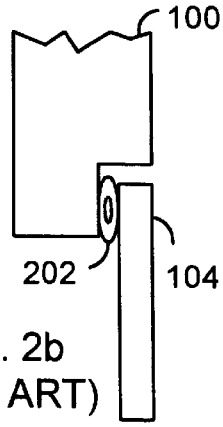
FIG. 2b (PRIOR ART)
Figure 3A:
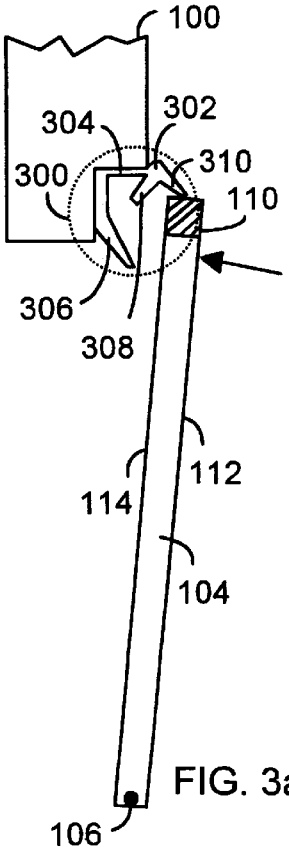
Figure 3B:
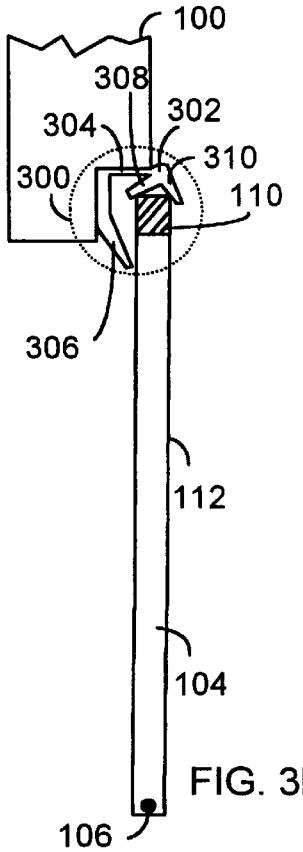
Figure 3C:
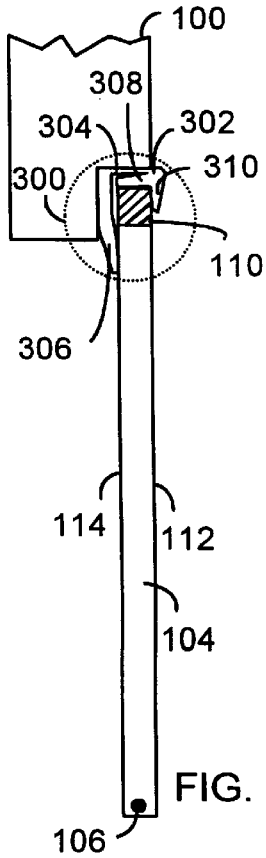
Figure 4A:
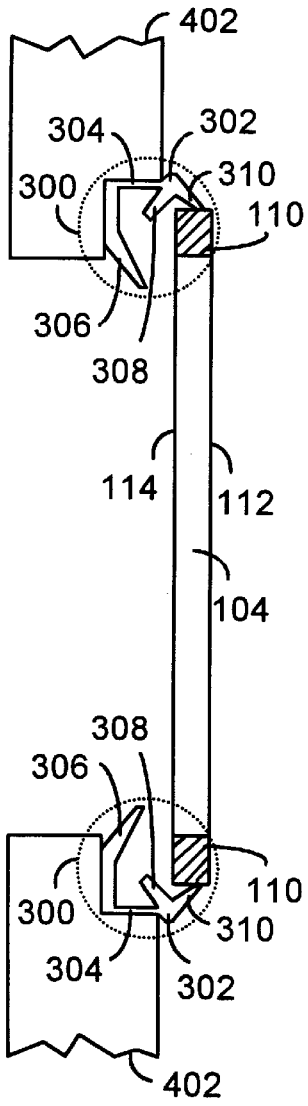
Figure 4B:
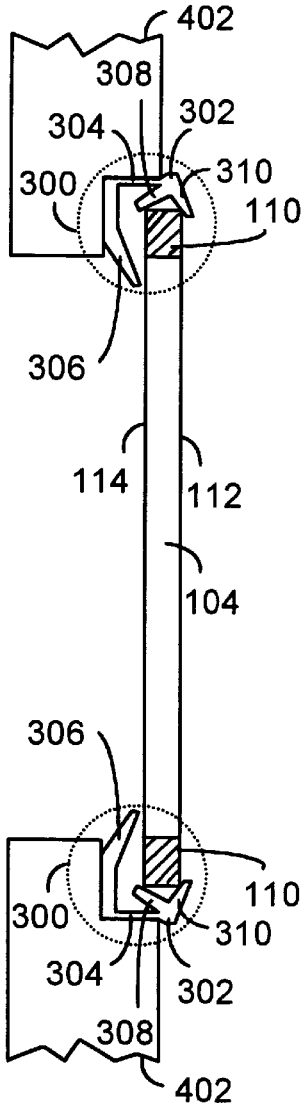
Figure 4C:
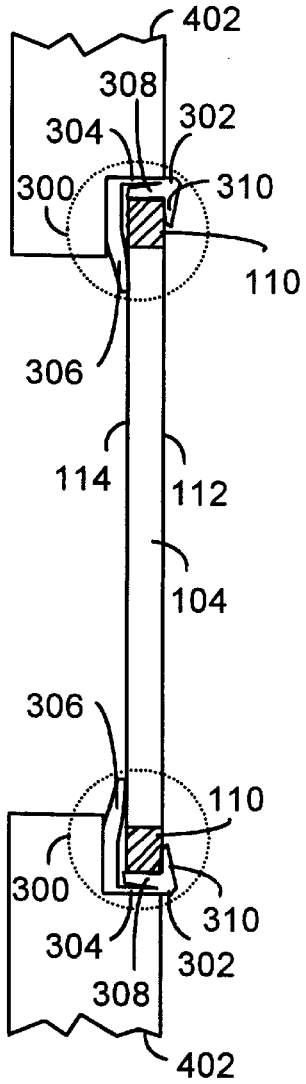
Figure 5:
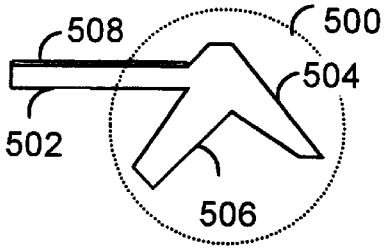
Figure 6:
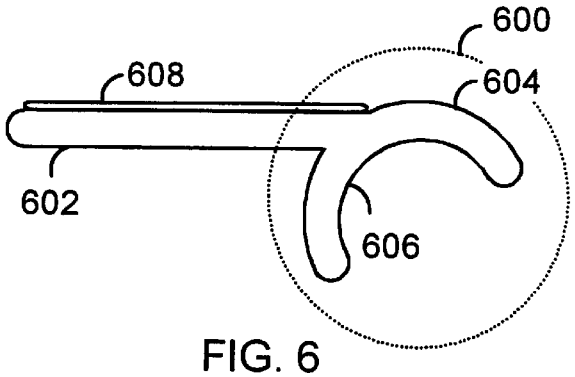
Figure 7:
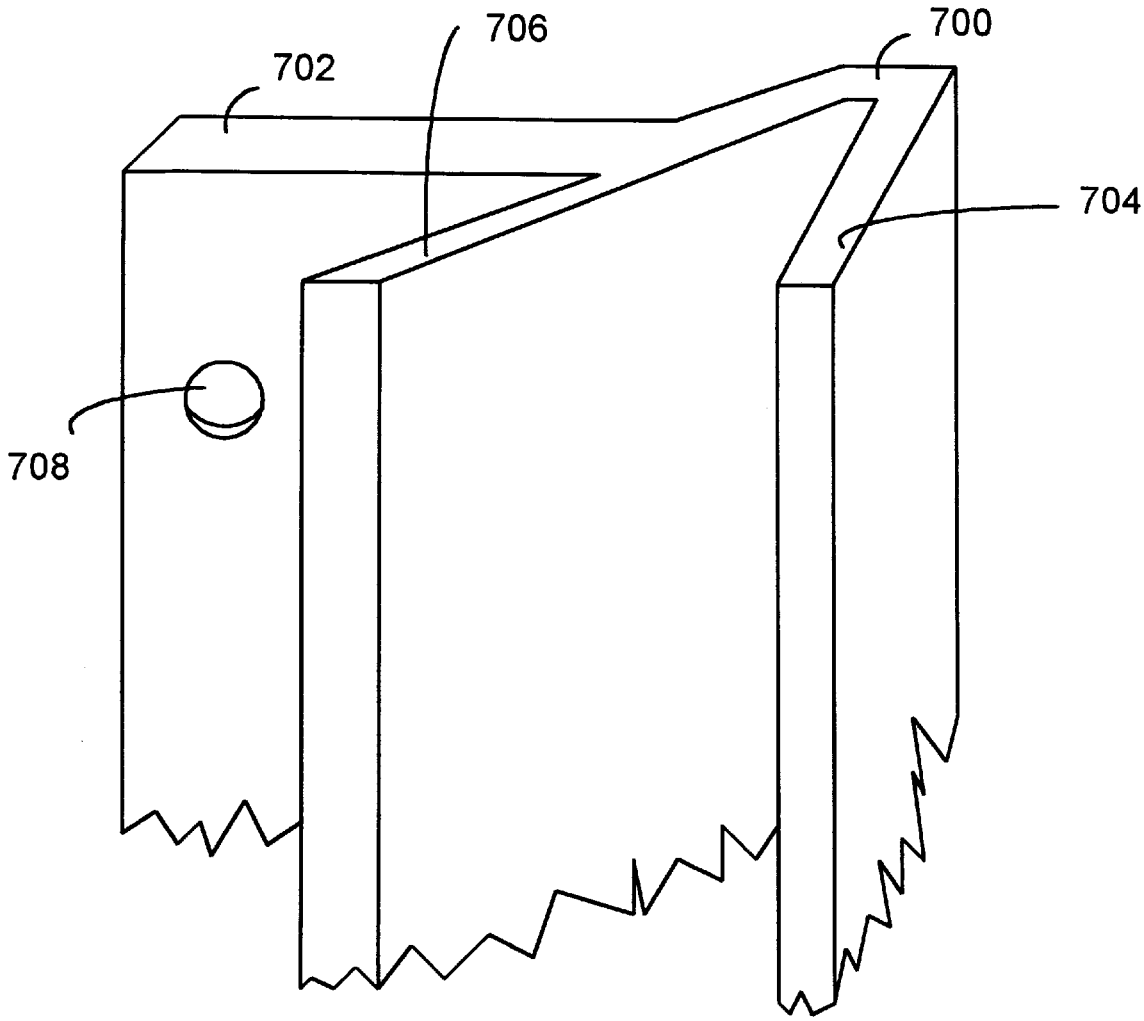

In the following the invention will be described in greater detail in connection with the preferred embodiments with reference to the accompanying drawings, in which FIG. 1*a* shows a lip seal while the door is open, FIG. 1*b* shows the lip seal while the door is closed, FIG. 2*a* shows a hollow seal while the door is open, FIG. 2*b* shows the hollow seal while the door is closed, FIG. 3*a* shows a seal of the invention while the hinged door is open, FIG. 3*b* shows the seal of the invention while the hinged door is closing, FIG. 3*c* shows a solution of the invention while the hinged door is closed, FIG. 4*a* shows the solution of the invention while the sliding door is open, FIG. 4*b* shows the solution of the invention while the sliding door is closing, FIG. 4*c* shows the solution of the invention while the sliding door is closed, FIG. 5 shows the seal of the invention in cross section, FIG. 6 shows the seal of the invention in cross section, and FIG. 7 shows the seal of the invention.

DETAILED DESCRIPTION OF THE INVENTION

The solution of the invention is particularly applicable for sealing a door or a hatch of a protective construction of a base station without restricting thereto. Here the door refers to doors, hatches, covers or windows that can be opened.

Let us first take a look at prior art solutions shown in FIGS. 1*a*–2*b*. In FIG. 1*a* the branches of a lip seal 102 forming a v-shaped cross section are spread out. The lip seal 102 is fastened to a frame 100 having an indentation for a door. In FIG. 1*b* a door 104 is closed and the door 104 presses the lip seal 102 against the frame 100 thus narrowing the v-shaped opening of the lip seal 102. In FIG. 2*a* a hollow, tubular seal 202 is fastened to the frame 100. The function of the hollow seal is based on the fact that the hollow seal is compressed when the door 104 is closed as shown in FIG. 3*b*.

Let us now examine the seal of the invention in greater detail. The seal is made of elastic material as in prior art solutions and it is as easy to manufacture as prior art seals. Technical rubber, silicone, EPMD (Ethylene Propylene Diene Monomer) and many elastic plastics can function as the elastic materials.

According to FIG. 3*a* a seal 300 comprises a first sealing portion 302, a fastening portion 304 by which the seal is fastened to the frame 100 and a second sealing portion 306. The second sealing portion 306 is a lip seal in this example, but it can also be any prior art seal like a hollow seal. In this example, the door 104 comprises a hinge 106, an edge 110, an outer surface 112 and an inner surface 114. The edge 110 refers to the side of the door 104 that opens in contrast to the hinged side. Although the edge 110 is separated from the rest of the door by hatching it, the edge 110 need not be structurally different from the rest of the door material. The outer surface 112 of the door 104 is in this example the side, in which direction the door opens. The inner surface 114 is the opposite side of the outer surface 112. In FIG. 3*a* the door 104 is still open but closing. Then the edge 110 of the door 104 is close to the first sealing portion 302 or touches it.

In FIG. 3*b* the door 104 is nearly closed. In this example, the edge 110 of the door 104 touches the first sealing portion 302 and pushes it towards its final position. The door 104 thus controls the first sealing portion 302. The edge 110 compresses the first side 308 of the first sealing portion 302 whereby the first sealing portion 302 turns in such a manner that the second side 310 of the first sealing portion 302 moves towards the outer surface 112 of the door 104.

In FIG. 3*c* the door 104 is closed and the first sealing portion 302 efficiently seals the seam between the door 104 and the frame 100. Then the first side 308 of the first sealing portion 302 is against the edge 110 of the door 104 at the same time as it is preferably pressed, at least partly, against the fastening portion 304 of the seal 300. The second side 310 of the first sealing portion 302 now slightly overlaps the outer surface 112 of the door 104. In this case, no gaps are left between the door 104 and the seal 300, since the door 104 and the seal are tightly pressed against each other. No gaps can either be left between the seal 300 and the frame 100, since the seal 300 is firmly fastened to the frame 100. The second sealing portion 306 improving the sealing is a lip seal. However, although FIGS. 3*a*–3*c* show an indentation in the frame 100, it is not, as is obvious to one skilled in the art, necessarily needed, particularly if the second sealing portion 306 is not used. The frame 100 can be made of the same or a different material than the other wall parts. What is essential to the frame 100 is that it serves the door as the frame of a corresponding opening.

FIG. 4 shows a solution where a door 404 does not include a hinge but where the door is, for example, a sliding door or equivalent. In this example, the door 404 comprises edges 410, an outer surface 412 and an inner surface 414. In FIG. 4*a* the door 404 is still open but closing. Then the edges 410 of the door 404 are close to the first sealing portions 302 or are touching it.

In FIG. 4*b* the door 404 is nearly closed. In this example, the edges 410 of the door 404 touch and push the first sealing portions 302 towards their final position. The door 404 thus controls the first sealing portions 302 in the same way as in the examples of FIG. 3*b*. The edges 410 compress the sides 308 of the first sealing portions 302, whereby the first sealing portions 302 turn in such a manner that the second sides 310 of the first sealing portions 302 move towards the outer surface 412 of the door 404.

In FIG. 4*c* the door 404 is closed and the first sealing portions 302 efficiently seal the seam between the door 404 and the frames 400. Then the first sides 308 of the first sealing portions 302 are against the edge 410 of the door 404 at the same time as they are preferably also pressed, at least partly, against the fastening portions 304 of the seal 300. The second side 310 of the first sealing portions 302 now slightly overlaps the outer surface 412 of the door 404. Then no gaps are left between the door 404 and the seal 300, since the door 404 and the seals 300 are tightly pressed against each other. No gaps can either be left between the seals 300 and the frames 400 since the seals 300 are firmly fastened to the frames 400.

The most important feature of the invention is that, when closing, the door actively turns the first sealing portion 302 in such a way that the seal fills the seam between the door and the frame, and at least a part of the first sealing portion 302 also extends over the edge of the door onto the outer surface in order to improve the sealing. Then the seal uniformly extends from the outer surface of the door to the fastening portion and firmly closes the seam between the door and the frame. Neither dust nor water can come between the sealing portion and the frame, since the sealing portion is usually very tightly fastened to the frame.

FIGS. 5 and 6 show two different cross sections of the seal. They are merely examples of different shapes which are not as such important to the invention. What is important is that the seals are formed to fit the door. The seal in FIG. 5 comprises only the most essential parts of the seal of the invention. The seal comprises a first sealing portion 500 including two sides 504 and 506 forming a v-shaped groove, and a fastening portion 502. The seal of the invention does not need to include a lip-like sealing portion as shown in FIGS. 3*a*–3*c* and 4*a*–4*c*, although it conveniently complements the invention. The fastening portion may comprise an adhesive surface 508 to facilitate fastening. FIG. 6 shows a seal comprising the same portions but with slightly rounded shapes. The seal comprises a first sealing portion 600 including two sides 604 and 606 forming a u-like groove and a fastening portion 602. An adhesive surface 608 of the fastening portion 602 is also included in FIG. 6. The rotating motion of the first sealing portion 500, 600 in relation to the fastening portion 502, 602 is preferably implemented using the elasticity of the seal. The seal is preferably a uniform piece made of a single material. The seal can also be composed of at least two materials, for example, so that the fastening portion 502, 602 is less elastic than the first sealing portion 500, 600.

FIG. 7 is a three-dimensional picture showing the seal of the invention. The inventive seal is preferably strip-like. The seal comprises a first sealing portion 700, a fastening portion 702, sides 704 and 706. In addition, as an example of various fastening methods a hole 708 from where the seal can be fastened is drawn to the fastening portion 702. Neither a hole nor an adhesive surface is needed in the seal, but the seal can be fastened using prior art fastening methods employing adhesives or mechanical fastening. The fastening portion 702 may include the adhesive or it may be put therein during fastening. The seal can be fastened from the holes or the fastening portion 702 of the seal can be penetrated using fastening means (staple, nail, screw etc.) The fastening portion may also include mechanical fastening means that match the counterparts of the fastening means in the frame. In order to improve the efficiency of the sealing the seal 700 can be conductive, in which case it also prevents electromagnetic radiation from passing through the seal in either direction. In order to obtain a conductive seal known methods are used, for example, metal fibres, metal filament, metal lamellas or expanded metal are added into the seal material. The material as such can also be conductive.

Even though the invention has been described above with reference to the example of the accompanying drawings, it is obvious that the invention is not restricted thereto but can be modified in various ways within the scope of the inventive idea disclosed in the attached claims.

What is claimed is:

1. A closure assembly comprising:

a door frame, the door frame including an edge surface;

a door having an inner surface, an outer surface, and a side edge surface, the door inner and outer surfaces being orientated to face in generally opposite directions; and a seal attached to the door frame for mating engagement with the door;

wherein the door is configured to move relative to the door frame from an open position, where the door side edge surface is disposed at a distance from the door frame edge surface, to a closed position where the door has moved inwardly and The door side edge surface opposes the door frame edge surface, the seal including a first side arranged to provide sealing engagement with the door side edge surface, and a second side arranged to provide sealing engagement with the door outer surface, the seal first side disposed proximate to the door frame edge surface for movement relative to the door frame edge surface, the seal also being configured to move relative to the door from the door open position, where the seal first side is disposed at a spaced apart distance from the door frame edge surface, to the door closed position, where the seal first side has moved inwardly and is disposed closer to the door frame edge surface than at the door open position, and the seal being configured to further move relative to the door from the door open position, where the seal second side is not disposed adjacent to the door outer surface, to the door closed position where the seal second side is disposed adjacent to the door outer surface and in covering relation to the door outer surface.

2. The closure of claim 1, wherein the seal first side contacts the door frame edge surface, and is compressed between the door frame edge surface and the door side edge surface in the door closed position.

3. The closure of claim 1, wherein the seal first side and second side are attached, and wherein the first and second sides are configured to move in unison in a rotating motion from the door open position to the door closed position.

4. The closure of claim 3, wherein the seal first side and second side are separated by a groove.

5. The closure of claim 1, wherein the seal further comprises a lip seal coupled to the first and second sides to provide engagement with the door inner surface, the lip seal being disposed at a spaced apart distance from the first and second sides, the lip seal being configured to move relative to the door from the door open position, where the lip seal extends outwardly and the lip seal is not in contact with the door inner surface, to the door closed position, where the lip seal is in contact with the door inner surface and has moved inwardly.

6. The closure of claim 1, wherein the seal further comprises a fastening portion, and wherein the fastening portion is attached to the door frame.

7. The closure of claim 6, wherein the seal further comprises a fastener, the fastener forming the attachment of the fastening portion to the door frame.

8. The closure of claim 7, wherein the fastener is an adhesive.

9. The closure of claim 1, wherein the seal is electrically conducive.

10. The closure of claim 1, wherein door frame includes an outer surface and wherein the outer surface of the door in the door closed position is generally disposed parallel to the outer surface of the door frame.

* * * * *